US006087639A

United States Patent [19]

Engelke et al.

[11] Patent Number: 6,087,639

[45] Date of Patent: Jul. 11, 2000

[54] HEATING COIL RETAINER BRACKET AND METHOD FOR MANUFACTURING THE SAME

[75] Inventors: Roger P. Engelke, Holland, Mich.; Leon Lietch, Huntsville, Ala.

[73] Assignee: Hart & Cooley, Inc., Holland, Mich.

[21] Appl. No.: 09/350,617

[22] Filed: Jul. 9, 1999

Related U.S. Application Data

[60] Provisional application No. 60/093,199, Jul. 17, 1998.

[51] Int. Cl.[7] ..... H05B 3/06

[52] U.S. Cl. ..... 219/542; 219/532; 174/138; 174/148; 29/611

[58] Field of Search ..... 174/138 S, 148; 219/532, 542; 392/350; 29/611

[56] References Cited

U.S. PATENT DOCUMENTS

| | | | |
|---|---|---|---|
| 1,628,876 | 5/1927 | Ehrgott . | |
| 3,641,312 | 2/1972 | Ammerman et al. | 219/532 |
| 3,697,727 | 10/1972 | Neuman et al. | 219/532 |
| 3,811,031 | 5/1974 | McBride et al. | 392/350 |
| 3,812,322 | 5/1974 | Osterkorn et al. | 219/532 |
| 3,883,721 | 5/1975 | Paulson et al. | 219/532 |
| 3,890,487 | 6/1975 | Wightman et al. . | |
| 3,920,887 | 11/1975 | Kloos et al. | 174/148 |
| 3,943,333 | 3/1976 | Kokjohn et al. | 219/532 |
| 3,952,409 | 4/1976 | Allison et al. . | |
| 3,963,859 | 6/1976 | Peterson et al. | 174/148 |
| 3,992,609 | 11/1976 | Alexander . | |
| 4,628,189 | 12/1986 | Danko | 219/532 |
| 4,656,340 | 4/1987 | St. Louis . | |
| 5,122,640 | 6/1992 | Holmes | 219/532 |
| 5,134,270 | 7/1992 | Bragg et al. | 219/532 |
| 5,477,605 | 12/1995 | McWilliams et al. | 29/611 |

*Primary Examiner*—Teresa Walberg
*Assistant Examiner*—Leonid Fastovsky
*Attorney, Agent, or Firm*—Rader, Fishman, Grauer & McGarry

[57] ABSTRACT

A retainer bracket for an electric heating assembly is provided with a pair of parallel and opposing side beams having longitudinal axes and at least one planar transverse support formed integral with the pair of side beams and extending between the pair of side beams. The transverse support preferably has a plurality of openings with longitudinal axes and the transverse support is disposed so that the axes of the openings are parallel to the longitudinal axes of the side beams. The plurality of openings are thereby each adapted to receive and retain an insulator without a separate fastener. A method of making the heating coil retainer bracket from a single web of material is also contemplated.

65 Claims, 2 Drawing Sheets

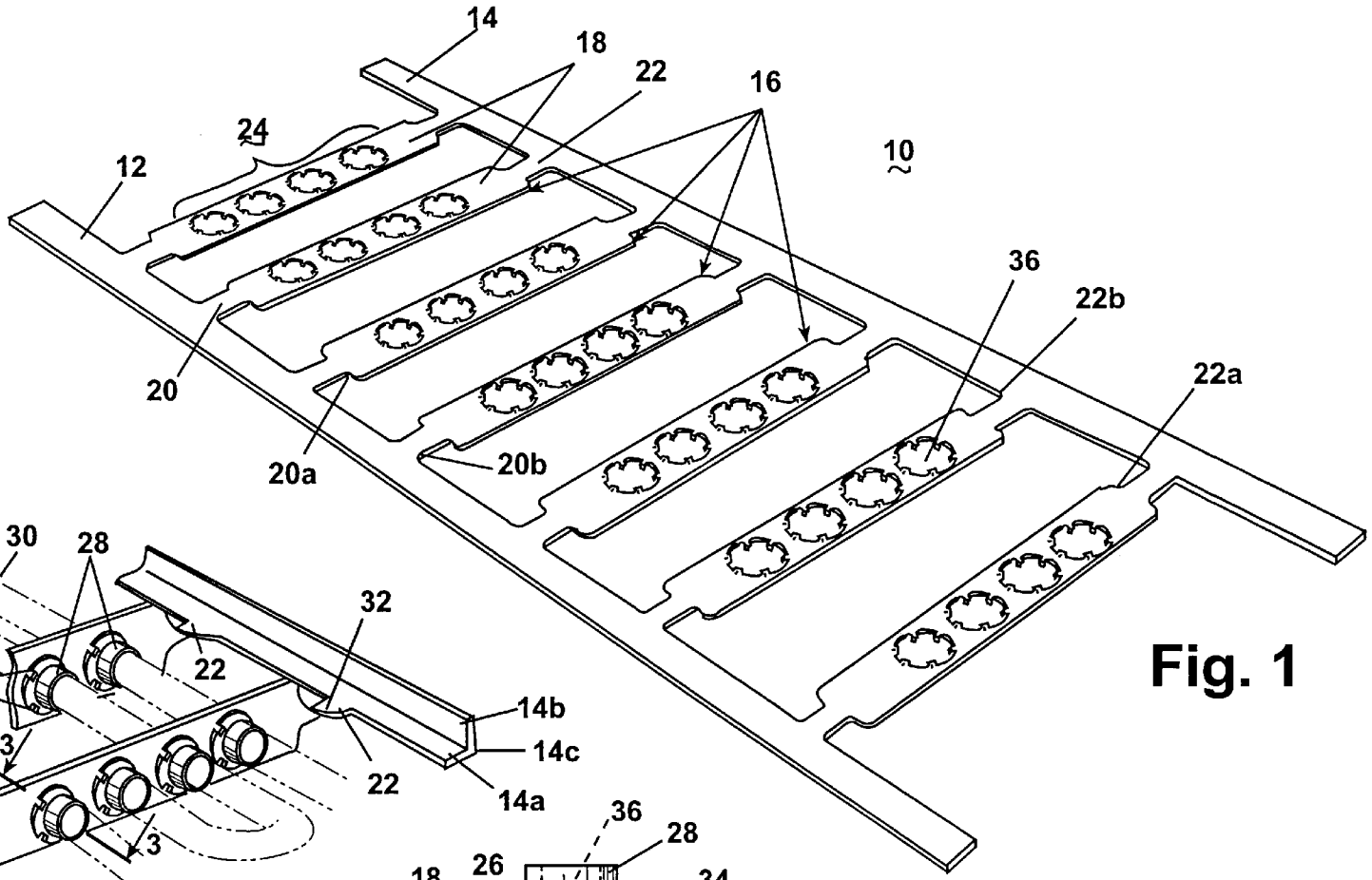
Fig. 1
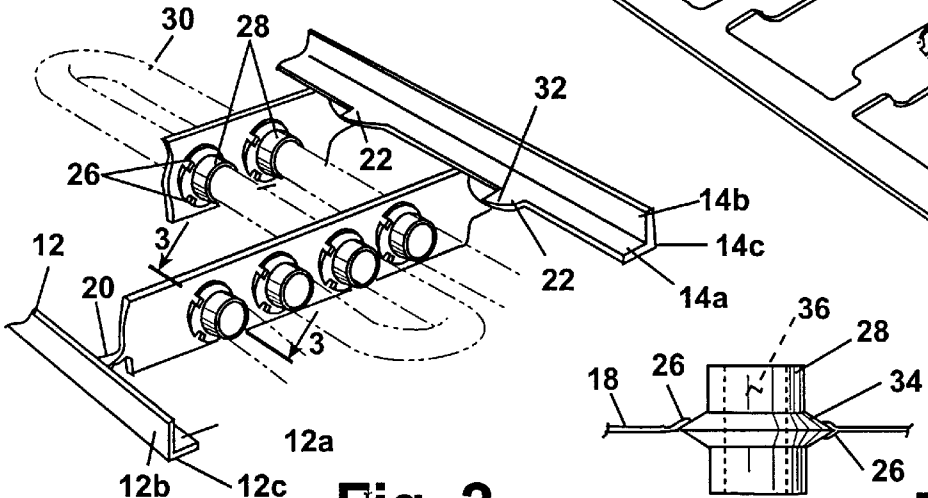
Fig. 2
Fig. 3

HEATING COIL RETAINER BRACKET AND METHOD FOR MANUFACTURING THE SAME

CROSS-REFERENCE TO RELATED APPLICATIONS

This application claims the benefit of U.S. Provisional Patent Application Ser. No. 60/093,199 filed on Jul. 17, 1998.

BACKGROUND OF THE INVENTION

1. Field of the Invention

This invention relates to a heater assembly and in particular to a retainer bracket for mounting a heating coil of the heater assembly and to a method for manufacturing the retainer bracket.

2. Related Art

Heating assemblies having coil-type heating elements are generally formed by passing the coil element, usually in a serpentine manner, through ring or grommet-type insulators which are supported by a metal retainer bracket. The object of the manufacture of these retainer brackets is to provide a rigid, and therefore reliable, retainer bracket at the lowest cost in materials, labor, and tooling.

A common method of producing the retainer bracket is to advance a piece of sheet metal through a plurality of work stations, such as in a progressive die machine, whereby particular features of the retainer bracket are formed at each station. Typically, once the sheet metal is deformed through stamping, side supports are connected by rivets or screws to the stamped structure for the purpose of increasing rigidity of the completed retainer bracket. Using fasteners to secure the side supports increases the overall material costs in assembling the retainer bracket and increases the cost of manufacture thereof.

It is paramount to the integrity of the assembly of the retainer bracket that the particular structure that receives and retains the heating coils be rigidly attached to the retainer bracket. More specifically, when that particular structure is not integral to the support structure, overall rigidity and reliability of the retainer bracket is lessened and the costs of manufacture are increased.

For example, U.S. Pat. No. 3,952,409 to Allison et al. teaches a bracket for an electric heating assembly comprising a pair of parallel side supports which mount several separate U-shaped transverse supports interlocked with the side supports by a tab-in-slot arrangement. The U-shaped supports have a pair of spaced side walls which form a recess for receipt of several insulator blocks which are held in place by tabs bent over a tab on each of the insulator blocks.

U.S. Pat. No. 3,992,609 to Alexander discloses a bracket very similar to that shown in the Alexander '609 patent but wherein the U-shaped supports for the insulator blocks are formed integral with the side supports. A planar, undeformed connecting piece of material extends between the side supports and the U-shaped supports to provide support between the respective components of the bracket.

However, these and other prior art attempts still require additional manufacturing cost as well as require additional material and fasteners for assembly of the heating coil retainer bracket with sufficient structural strength.

SUMMARY OF THE INVENTION

In one aspect, the invention relates to a retainer bracket for an electric heating assembly comprising a pair of parallel and opposing side beams having longitudinal axes, at least one planar transverse support formed integral with the pair of side beams and extending between the pair of side beams, the transverse support having a plurality of openings with longitudinal axes, and the transverse support disposed so that the axes of the openings are parallel to the longitudinal axes of the side beams. The plurality of openings are thereby each adapted to receive and retain an insulator without a separate fastener.

In various embodiments of the aspects of the invention, the side beams can be L-shaped for reinforcement thereof. A plurality of locking tabs can extend into each of said openings adapted to retain insulators therein. The insulators can be mounted within each of the openings. Locking tabs can be located within each of the openings wherein the insulators are retained within the openings by the locking tabs. The locking tabs can be bent in at least one of a first lateral direction and a second lateral direction whereby the locking tabs prevent movement of the insulators within the openings in the at least the first and second directions. The at least one transverse support can comprise at least two transverse supports wherein the plurality of openings on one transverse support are aligned with the plurality of openings on another transverse support. A heater coil can be wound in serpentine fashion through the plurality of openings in each transverse support. The at least one transverse support member can be a single planar member.

A support flange can be formed integrally with each end of the at least one transverse support and can extend between the end of the at least one transverse support and the adjacent side beam. Each support flange can be twisted so that the axis of each of the plurality of openings is parallel to the longitudinal axes of the opposing side beams. At least one of the openings on the at least one transverse support can comprise a circular aperture therein. The transverse support has a first transverse edge and at least one of the openings on the at least one transverse support comprises a partial circular aperture extending inwardly from the transverse edge.

In another aspect, the invention comprises a retainer bracket for an electric heating assembly comprising a pair of parallel and opposing side beams having longitudinal axes, at least one transverse support formed integral with the pair of side beams and extending between the pair of side beams wherein the transverse support has a plurality of openings with longitudinal axes. The transverse support is preferably disposed so that the axes of the openings are parallel to the longitudinal axes of the side beams. A support flange is preferably formed integrally with each end of the at least one transverse support and extends between the end of the at least one transverse support and the adjacent side beam. Each support flange is preferably twisted so that the axis of each of the plurality of openings is parallel to the longitudinal axes of the opposing side beams.

In a further aspect, the invention relates to an electric heating assembly comprising a heating element supported by a plurality of insulators mounted to a retainer bracket. The retainer bracket comprises a pair of a pair of parallel and opposing side beams having longitudinal axes and at least one transverse support formed with the pair of side beams and extending between the pair of side beams. The transverse support has a plurality of openings with longitudinal axes wherein the transverse support is preferably disposed so that the axes of the openings are parallel to the longitudinal axes of the side beams. The invention relating to an improvement in an assembly of this type wherein the plurality of openings are each adapted to receive and retain an insulator without a separate fastener.

In yet an additional aspect, the invention relates to an electric heating assembly comprising a heating element supported by a plurality of insulators mounted to a retainer bracket. The retainer bracket comprises a pair of a pair of parallel and opposing side beams having longitudinal axes and at least one transverse support formed with the pair of side beams and extending between the pair of side beams. The transverse support has a plurality of openings with longitudinal axes and wherein the transverse support is preferably disposed so that the axes of the openings are parallel to the longitudinal axes of the side beams. The invention relating to an improvement in an assembly of this type wherein each of the at least one transverse support is formed from a planar length of material formed unitary with the side beams.

In another aspect, the invention relates to a method of forming a heating coil retainer bracket for an electric heating assembly by advancing a piece of sheet metal though a plurality of workstations comprising the steps of removing excess material from the piece of sheet metal to form a pair of parallel and opposing side beams having longitudinal axes, at least one planar transverse support extending between the pair of side beams, and a plurality of openings with longitudinal axes in the at least one transverse support; bending the at least one transverse support wherein the axes of the openings are parallel to the longitudinal axes of the side beams; and mounting an insulator within each of the plurality of openings.

The method can also include additional steps such as bending the side beams into a channel beam; forming retainer tabs on the openings; forming support flanges on the ends of the transverse support; and twisting the support flanges during the step of bending the at least one transverse support. The invention also contemplates a heater coil retainer bracket formed by these steps.

In yet a further aspect, the invention relates to a method of forming an electric heating assembly comprising the steps of removing excess material from a piece of sheet metal to form a pair of parallel and opposing side beams having longitudinal axes, at least one planar transverse support extending between the pair of side beams, and a plurality of openings with longitudinal axes in the at least one transverse support; bending the at least one transverse support wherein the axes of the openings are parallel to the longitudinal axes of the side beams; mounting an insulator within each of the plurality of openings; and winding a heating coil in serpentine fashion through longitudinal bores in the insulators. The invention also contemplates an electric heating assembly formed by this method.

Other objects, features, and advantages of the invention will be apparent from the ensuing description in conjunction with the accompanying drawings.

BRIEF DESCRIPTION OF THE DRAWINGS

In the drawings:

FIG. 1 is a perspective view of a partially-formed heating coil retainer bracket;

FIG. 2 is a perspective view, partially broken away, of a completed retainer bracket having a heating coil wound therethrough;

FIG. 3 is a fragmentary cross-sectional view of a ceramic insulator mounted in an aperture of the support beam taken along line 3—3 of FIG. 2;

DETAILED DESCRIPTION

Figure 4:
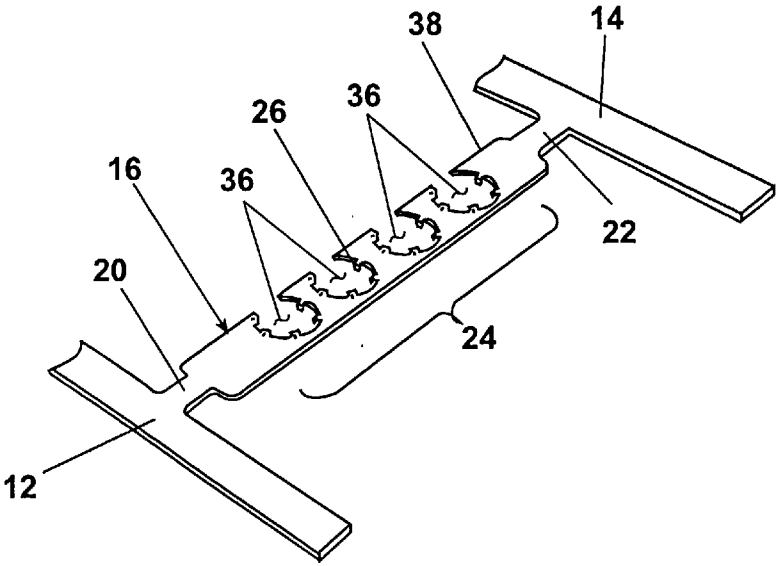
FIG. 4 is a fragmentary, perspective view of a second embodiment of the heating coil retainer bracket of FIG. 1.

Referring now to the drawings and to FIG. 1 in particular, a partially-formed heating coil retainer bracket, shown generally at 10, comprises a pair of parallel side beams 12 and 14 which support several transversely-extending supports 16. Each transverse support 16 comprises a support beam 18 connected to the side beams 12 and 14 by narrow support flanges 20 and 22, respectively. The support flanges 20 and 22 include ends 20*a* and 22*a*, which are adjacent the beam 18, and ends 20*b* and 22*b*, 5 which are adjacent the parallel side beams 12 and 14, respectively, as shown in FIG. 2.

Each support beam 18 further includes a plurality of apertures 24 in spaced linear relationship along a longitudinal axis of the support beam 18. The apertures 24 include several circumferentially-spaced tabs 26 for securing ceramic insulators 28 within the apertures 24.

As shown in FIG. 3, the ceramic insulators 28 comprise a cylindrical body having a coaxial longitudinal bore 36 therethrough and a circumferential ridge 34 centered thereon.

It will be understood that the retainer bracket 10 of FIG. 1 is shown following a stamping process to form the bracket 10 and prior to a finishing process. In the finishing process, the retainer bracket 10 is formed into the configuration in FIGS. 2–3 and provided with the insulators 28 and the heater coil 30.

As shown in FIGS. 2–3, the parallel side beams 12 and 14 of the retainer bracket 10 comprise opposing L-shaped supports having a longitudinal axis 12*c* and 20 14*c*, respectively. The side beam 12 includes a substantially vertical face 12*b* and a substantially horizontal face 12*a*, and the side beam 14 includes a substantially vertical face 14*b* and a substantially horizontal face 14*a*. The support flanges 20 and 22, adjacent either end of the support beams 18, include a bend 32 formed by rotating the ends 20*a* and 22*a* approximately 90 degrees relative to the ends 20*b* and 22*b* so that the support beams 18 of the transverse supports 16 are disposed vertically and the apertures 24 are axially aligned.

The insulators 28 are placed within each aperture 24 and retained therein by bending each tab 26 forwardly and rearwardly of the ridge 34 on the insulator 28. Thus, the tabs 26 prevent axial movement of the insulators with respect to the corresponding aperture 24.

The heating coil 30 is passed in a serpentine fashion through the bores 36 of the insulators 28 in an aligned set of apertures 24 as shown in FIG. 2. Ends of the heating coil 30 can be connected to a source of power in a conventional manner whereby actuation of the power source causes the heating coil to emit thermal radiation. The insulators 28 prevent excessive heat from being transmitted to the retainer bracket 10 and also provide electrical insulation between the retainer bracket 10 and the heating coil 30.

The retainer bracket 10 is manufactured by the following steps. First, excess material is removed from a flat blank (not shown), preferably sheet metal, via stamping or a similar process to form the retainer bracket 10 as shown in FIG. 1, comprising the parallel side beams 12 and 14 supporting the transverse support beams 18. The removal of excess material also forms the apertures 24, which are formed in a spaced relation and include the tabs 26. The side beams 12 and 14 are bent upwardly along longitudinal axes 12*c* and 14*c*, respectively, to form integral side beams for the support of the retainer bracket 10 having opposing L-shaped cross sections defined by horizontal portions 12*a* and 14*a*, and upwardly-extending portions 12*b* and 14*b*, respectively, as shown in FIG. 2. The ceramic insulators 28 are then mounted within the apertures 24 on the support beam 16, as shown in FIG. 3, and previously described. The transverse supports 16 are bent at the support flanges 20 and 22 to form the bends 32, such that the rectangular beam 18 is disposed vertically and sets of the apertures 24 are aligned axially, as shown in FIG. 2. The heating coil 30 is wound in the conventional, serpentine fashion and passed axially through the longitudinal bores 36 of the connectors 28, whereby the heating coil 30 is secured in the retainer bracket 10 as shown in FIG. 2.

Figure 5:
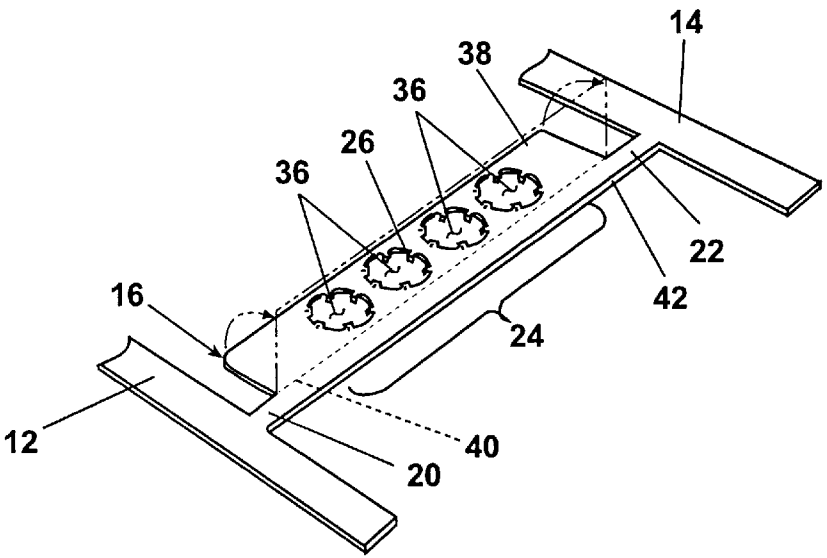
FIG. 5 is a fragmentary, perspective view of a third embodiment of the heating coil retainer bracket of FIG. 1.

FIGS. 4–5 show first and second embodiments, respectively, of the heating coil retainer bracket 10 shown in FIG. 1. It will be understood that common reference numerals are employed to identify common elements between the first embodiment shown in FIGS. 1–3 and the alternative embodiments shown in FIGS. 4 and 5.

FIG. 4 is a fragmentary, perspective view of a second embodiment of the heating coil retainer bracket 10 shown in FIG. 1. In this embodiment, the transverse support 16 has openings 36 which are formed as partial circular recesses extending inwardly from an edge 38 of the transverse support 16. The support flanges 20 and 22 are deformed to position the transverse support in a generally vertical position as described with respect to the previous embodiment of FIGS. 1–3. The openings 36 can be provided with locking tabs 26 as well.

FIG. 5 is a fragmentary, perspective view of a third embodiment of the heating coil retainer bracket of FIG. 1. In this embodiment, the transverse support 16 has a folding axis 40 defined adjacent to and parallel to an edge 42 thereof. The transverse support 16 is deformed along the folding axis 40 to be located in a generally orthogonal position relative to the side beams 12 and 14. It should be noted that, in this embodiment, the support flanges 20 and 22 are not deformed but rather the transverse support 16 is deformed along the folding axis 40 to position the transverse support 16 in the orthogonal position (shown in phantom lines in FIG. 5).

In any of the embodiments, it should be noted that the transverse support 16 is located in a position wherein longitudinal axes of the openings 36 are generally parallel to the side beams 12 and 14. Because the side beams and transverse support 16 are formed integral with one another, the transverse support 16 can be stamped from a single piece of material is located in the orthogonal position by deformation of the transverse support 16 itself, or by deforming the support flanges 20 and 22.

In any event, the resulting retainer bracket 10 is low cost and efficient to manufacture requiring, at a minimum, stamping the retainer bracket out of a suitable piece of material and positioning the transverse support 16 into a generally orthogonal position so that the heating coil 30 can be wound in a serpentine fashion through the aligned openings 36.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

What is claimed is:

1. A retainer bracket blank for an electric heating assembly comprising:

a pair of parallel and opposing side beams having longitudinal axes;

at least one planar transverse support extending between the pair of side beams, the transverse support and the side beams formed as an integral unit into a planar member;

said transverse support having a plurality of openings with longitudinal axes;

said transverse support being movable into a plane other than the plane of the planar member so that the axes of the openings can be parallel to the longitudinal axes of the side beams;

whereby a retainer bracket can be formed from the retainer bracket blank and can retain insulators without any separate fasteners or connections.

2. The retainer bracket blank of claim 1 wherein the side beams are L-shaped for reinforcement thereof.

3. The retainer bracket blank of claim 2 and further comprising a plurality of locking tabs extending into each of said openings adapted to retain insulators therein.

4. The retainer bracket blank of claim 3 wherein the insulators are mounted within each of the openings.

5. The retainer bracket blank of claim 4 and further comprising locking tabs bent located within each of the openings wherein the insulators are retained within the openings by the locking tabs.

6. The retainer bracket blank of claim 5 wherein the locking tabs are each bent in at least one of a first lateral direction and a second lateral direction whereby the locking tabs prevent movement of the insulators within the openings in the at least the first and second directions.

7. The retainer bracket blank of claim 6 wherein the at least one transverse support comprises at least two transverse supports wherein the plurality of openings on one transverse support are aligned with the plurality of openings on another transverse support.

8. The retainer bracket blank of claim 7 and further comprising a heater coil wound in serpentine fashion through the plurality of openings in each transverse support.

9. The retainer bracket blank of claim 1 wherein the at least one transverse support is a single planar member.

10. The retainer bracket blank of claim 1 and further comprising a support flange formed integrally with each end of the at least one transverse support and extending between the end of the at least one transverse support and the adjacent side beam;

wherein each support flange is twisted so that the axis of each of the plurality of openings is parallel to the longitudinal axes of the opposing side beams.

11. The retainer bracket blank of claim 10 wherein at least one of the openings on the at least one transverse support comprises a circular aperture therein.

12. The retainer bracket blank of claim 10 wherein the transverse support has a first transverse edge and at least one of the openings on the at least one transverse support comprises a partial circular aperture extending inwardly from the transverse edge.

13. The retainer bracket blank of claim 1 and further comprising a plurality of locking tabs extending into each of said openings adapted to retain insulators therein.

14. The retainer bracket blank of claim 1 and further comprising a plurality of insulators, each mounted within a corresponding one of the plurality of openings in the at least one transverse support.

15. The retainer bracket blank of claim 1 and further comprising locking tabs located within each of the plurality of openings.

16. The retainer bracket blank of claim 15 wherein the locking tabs are each bent in at least one of a first lateral direction and a second lateral direction whereby the locking tabs prevent movement of an insulator located within the openings in the at least the first and second lateral directions.

17. The retainer bracket blank of claim 1 wherein the at least one transverse support comprises at least two transverse supports wherein the plurality of openings on one transverse support are aligned with the plurality of openings on another transverse support.

18. The retainer bracket blank of claim 17 and further comprising a heater coil wound in serpentine fashion through the plurality of openings in each transverse support.

19. A retainer bracket for an electric heating assembly comprising:

a pair of parallel and opposing side beams having longitudinal axes;

at least one planar transverse support extending between the pair of side beams, the transverse support and the side beams formed as an integral unit into a planar member;

said transverse support having a plurality of openings with longitudinal axes; and wherein the at least one transverse support is moved so that the axis of each of the plurality of openings is parallel to the longitudinal axes of the opposing side beams.

20. The retainer bracket of claim 19 wherein the side beams are L-shaped for reinforcement thereof.

21. The retainer bracket of claim 20 and further comprising a plurality of locking tabs extending into each of said openings adapted to retain insulators therein.

22. The retainer bracket of claim 21 wherein the insulators are mounted within each of the openings.

23. The retainer bracket of claim 22 and further comprising locking tabs bent located within each of the openings wherein the insulators are retained within the openings by the locking tabs.

24. The retainer bracket of claim 23 wherein the locking tabs are each bent in at least one of a first lateral direction and a second lateral direction whereby the locking tabs prevent movement of the insulators within the openings in the at least the first and second directions.

25. The retainer bracket of claim 24 wherein the at least one transverse support comprises at least two transverse supports wherein the plurality of openings on one transverse support are aligned with the plurality of openings on another transverse support.

26. The retainer bracket of claim 25 and further comprising a heater coil wound in serpentine fashion through the plurality of openings in each transverse support.

27. The retainer bracket of claim 19 wherein at least one of the openings on the at least one transverse support comprises a circular aperture therein.

28. The retainer bracket of claim 19 wherein the transverse support has a first transverse edge and at least one of the openings on the at least one transverse support comprises a partial circular aperture extending inwardly from the transverse edge.

29. The retainer bracket of claim 19 and further comprising a plurality of locking tabs extending into each of said openings adapted to retain insulators therein.

30. The retainer bracket of claim 19 and further comprising a plurality of insulators, each mounted within a corresponding one of the plurality of openings in the at least one transverse support.

31. The retainer bracket of claim 19 and further comprising locking tabs located within each of the plurality of openings.

32. The retainer bracket of claim 31 wherein the locking tabs are each bent in at least one of a first lateral direction and a second lateral direction whereby the locking tabs prevent movement of an insulator located within the openings in the at least the first and second lateral directions.

33. The retainer bracket of claim 19 wherein the at least one transverse support comprises at least two transverse supports wherein the plurality of openings on one transverse support are aligned with the plurality of openings on another transverse support.

34. The retainer bracket of claim 33 and further comprising a heater coil wound in serpentine fashion through the plurality of openings in each transverse support.

35. In an electric heating assembly comprising a heating element supported by a plurality of insulators mounted to a retainer bracket, the retainer bracket comprising a pair of a pair of parallel and opposing side beams having longitudinal axes, at least one transverse support formed with the pair of side beams and extending between the pair of side beams, said transverse support having a plurality of openings with longitudinal axes, wherein the plurality of openings are each adapted to receive and retain an insulator without a separate fastener, the improvement comprising:

the opposing side beams and the at least one planar transverse support being formed as an integral unit into a planar member, the at least one transverse support being deformed relative to the opposing side beams so that the at least one transverse support is oriented in a plane other than the plane of the planar member so that the axes of the openings are parallel to the longitudinal axes of the side beams.

36. The electric heating assembly of claim 35 wherein at least one of the openings on the at least one transverse support comprises a circular aperture therein.

37. The electric heating assembly of claim 35 wherein the transverse support has a first transverse edge and at least one of the openings on the at least one transverse support comprises a partial circular aperture extending inwardly from the transverse edge.

38. The electric heating assembly of claim 35 and further comprising a plurality of locking tabs extending into each of said openings adapted to retain insulators therein.

39. The electric heating assembly of claim 35 and further comprising a plurality of insulators, each mounted within a corresponding one of the plurality of openings in the at least one transverse support.

40. The electric heating assembly of claim 35 and further comprising locking tabs located within each of the plurality of openings.

41. The electric heating assembly of claim 40 wherein the locking tabs are each bent in at least one of a first lateral direction and a second lateral direction whereby the locking tabs prevent movement of an insulator located within the openings in the at least the first and second lateral directions.

42. The electric heating assembly of claim 35 wherein the at least one transverse support comprises at least two transverse supports wherein the plurality of openings on one transverse support are aligned with the plurality of openings on another transverse support.

43. The electric heating assembly of claim 42 and further comprising a heater coil wound in serpentine fashion through the plurality of openings in each transverse support.

44. In an electric heating assembly comprising a heating element supported by a plurality of insulators mounted to a retainer bracket, the retainer bracket comprising a pair of a pair of parallel and opposing side beams having longitudinal axes, at least one transverse support formed with the pair of side beams and extending between the pair of side beams, said transverse support having a plurality of openings with longitudinal axes, said transverse support disposed so that the axes of the openings are parallel to the longitudinal axes of the side beams, the improvement wherein:

the opposing side beams and the at least one transverse support are formed from a unitary planar length of material.

45. The electric heating assembly of claim 44 wherein at least one of the openings on the at least one transverse support comprises a circular aperture therein.

46. The electric heating assembly of claim 44 wherein the transverse support has a first transverse edge and at least one of the openings on the at least one transverse support comprises a partial circular aperture extending inwardly from the transverse edge.

47. The electric heating assembly of claim 44 and further comprising a plurality of locking tabs extending into each of said openings adapted to retain insulators therein.

48. The electric heating assembly of claim 44 and further comprising a plurality of insulators, each mounted within a corresponding one of the plurality of openings in the at least one transverse support.

49. The electric heating assembly of claim 44 and further comprising locking tabs located within each of the plurality of openings.

50. The electric heating assembly of claim 49 wherein the locking tabs are each bent in at least one of a first lateral direction and a second lateral direction whereby the locking tabs prevent movement of an insulator located within the openings in the at least the first and second lateral directions.

51. The electric heating assembly of claim 44 wherein the at least one transverse support comprises at least two transverse supports wherein the plurality of openings on one transverse support are aligned with the plurality of openings on another transverse support.

52. The electric heating assembly of claim 51 and further comprising a heater coil wound in serpentine fashion through the plurality of openings in each transverse support.

53. A method of forming a heating coil retainer bracket for an electric heating assembly by advancing a piece of sheet metal through a plurality of workstations comprising the steps of:

removing excess material from the piece of sheet metal to form a pair of parallel and opposing side beams having longitudinal axes, at least one planar transverse support extending between, and formed unitary with, the pair of side beams, and a plurality of openings with longitudinal axes in the at least one transverse support;

bending the at least one transverse support wherein the axes of the openings are parallel to the longitudinal axes of the side beams; and mounting an insulator within each of the plurality of openings.

54. The method of claim 53 and further comprising the step of bending the side beams into a channel beam.

55. The method of claim 54 and further comprising the step of forming retainer tabs on the openings.

56. The method of claim 55 and further comprising the step of forming support flanges on the ends of the transverse support.

57. The method of claim 56 and further comprising the step of twisting the support flanges during the step of bending the at least one transverse support.

58. A heater coil retainer bracket formed by the method of claim 53.

59. The method of claim 53 and further comprising the step of forming retainer tabs on the openings.

60. The method of claim 53 and further comprising the step of forming support flanges on the ends of the transverse support.

61. The method of claim 53 and further comprising the step of twisting the support flanges during the step of bending the at least one transverse support.

62. A method of forming an electric heating assembly comprising the steps of:

removing excess material from a piece of sheet metal to form a pair of parallel and opposing side beams having longitudinal axes, at least one planar transverse support extending between, and formed unitary with, the pair of side beams, and a plurality of openings with longitudinal axes in the at least one transverse support;

bending the at least one transverse support wherein the axes of the openings are parallel to the longitudinal axes of the side beams;

mounting an insulator within each of the plurality of openings; and winding a heating coil in serpentine fashion through longitudinal bores in the insulators.

63. An electric heating assembly formed by the method of claim 62.

64. The retainer bracket of claim 19 wherein a support flange extends between the at least one transverse support and the adjacent side beam.

65. The retainer bracket of claim 64 wherein the support flange has a twisted portion to accommodate the movement of the transverse support relative to the side beam.

* * * * *

UNITED STATES PATENT AND TRADEMARK OFFICE
CERTIFICATE OF CORRECTION

PATENT NO.: 6,087,639

DATED: July 11, 2000

INVENTOR(S): Roger P. Engelke and Leon Lietch

It is certified that error appears in the above-identified patent and that said Letters Patent are hereby corrected as shown below:

Claim 35, col. 2, lines 16-17, "a pair of a pair of parallel" should read --a pair of parallel--.

Claim 44, col. 2, lines 65-66, "a pair of a pair of parallel" should read --a pair of parallel--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*